US005307898A

United States Patent [19]

Purdy et al.

[11] Patent Number: 5,307,898

[45] Date of Patent: May 3, 1994

[54] AERIAL WORK APPARATUS

[76] Inventors: Paul J. Purdy, 4490 Statler Rd., Chambersburg, Pa. 17201; Matthew S. Purdy, 1701 N. 73rd Ter., Apt. #4, Kansas City, Kans. 66112

[21] Appl. No.: 28,941

[22] Filed: Mar. 8, 1993

[51] Int. Cl.[5] ..... B66F 11/04

[52] U.S. Cl. ..... 182/63; 182/2; 182/62.5; 52/118

[58] Field of Search ..... 182/2, 63, 62.5; 52/118; 212/268, 267, 269

[56] References Cited

U.S. PATENT DOCUMENTS

| | | | |
|---|---|---|---|
| 2,988,163 | 6/1961 | Foley | 182/2 |
| 3,411,606 | 11/1968 | Oldakowski | 182/2 |
| 4,511,015 | 4/1985 | Purdy | 182/2 |
| 4,775,029 | 10/1988 | MacDonald | 182/2 |

FOREIGN PATENT DOCUMENTS

| | | | |
|---|---|---|---|
| 0286301 | 10/1988 | European Pat. Off. | 182/2 |
| 3326673 | 12/1984 | Fed. Rep. of Germany | 182/141 |
| 2106074 | 4/1983 | United Kingdom | 182/141 |

*Primary Examiner*—Alvin C. Chin-Shue
*Attorney, Agent, or Firm*—Keil & Weinkauf

[57] ABSTRACT

An improved mast assembly for an aerial work apparatus having improved stability and safety. A telescoping vertical main mast is connected to a telescoping vertical auxiliary mast.

8 Claims, 4 Drawing Sheets

AERIAL WORK APPARATUS

BACKGROUND OF THE INVENTION

1. Field of the Invention

The present invention relates to an improved aerial work apparatus which provides greater elevation while maintaining improved stability.

2. Description of the Related Art

Aerial work apparatuses are used for a variety of purposes, such as repairs, construction, or other operations where it is necessary to elevate a worker. Many devices of this type are known in the prior art. U.S. Pat. No. 4,280,589 discloses a device having a multi-part mast and an extensible boom, all of these parts being operated by hydraulic cylinders. U.S. Pat. No. 4,133,411 teaches an extensible boom mounted on a moveable vehicle base. In U.S. Pat. No. 3,767,007 an extendable ladder is mounted on a turret. A method of driving a rotatable base plate by cylinders and a sprocket is shown in U.S. Pat. No. 3,179,267.

U.S. Pat. No. 4,511,015 teaches an aerial work apparatus with improved stability comprising a wheeled chassis; an aerial platform; a rotating base having a center line of rotation mounted on the wheeled chassis; a fully hydraulic, telescoping main vertical mast mounted on the rotating base plate slightly offset from the center line of rotation of the base plate in a direction opposite to the position of the aerial platform, which main vertical mast includes at least two telescoping sections, the lower section being smaller in cross-section than the next adjacent higher section, which sections are driven to reciprocate by a package of cylinders located within the innermost telescoping section so as to be removable therefrom without disassembly of the telescoping sections, and a telescoping boom mounted on one side of the uppermost section of the vertical mast and extending beyond the other side of said mast in a straddling manner to the aerial platform, said telescoping boom being operated by hydraulic cylinders located substantially on the one side of said vertical mast opposite the position of the aerial platform.

SUMMARY OF THE INVENTION

The present invention seeks to provide an aerial work platform which is capable of achieving greater vertical extension than the apparatus disclosed in U.S. Pat. No. 4,511,015 without sacrificing stability.

This aim is accomplished by a vertical telescoping main mast connected to and supporting at least one vertical telescoping auxiliary mast. Each mast contains at least an upper and lower telescoping sections. The lower section of each mast is smaller in cross-section than the next adjacent higher section and is capable of telescoping into the next higher section. The masts are attached by connecting means mounted on the upper section of the main mast and any supporting auxiliary mast. The lower section of the supported auxiliary mast fits into and is firmly attached to the connecting means. An aerial work platform may be connected directly to the uppermost section of the uppermost vertical telescoping auxiliary mast. Alternatively, an aerial work platform may be attached to the auxiliary mast through a boom. The main mast is attached at its lowermost end to a support base by an anchoring means.

The present invention, in its narrower aspect, relates to an improvement over the aerial platform apparatus disclosed in U.S. Pat. No. 4,511,015. The aerial work apparatus of the present invention provides increased extension while maintaining the improved stability provided by the apparatus of the above patent. The objective of increased extension is obtained by providing the vertical mast of the above patent, which is termed the main mast of the present invention, with at least one vertical telescoping auxiliary mast removably mounted to the upper section of the main mast. Each vertical auxiliary mast contains at least two telescoping sections, the lower section being of a smaller cross-section than the next adjacent higher section. The objective of maintained stability, relative to other designs, is achieved through a vertical telescoping motion as opposed to achieving it through increased length and articulation of the boom. The latter increases the gravity-induced overturning moment that must be counterbalanced. The apparatus of the present invention reduces the necessity for counterbalancing.

DESCRIPTION OF THE PREFERRED EMBODIMENTS

Figure 1:
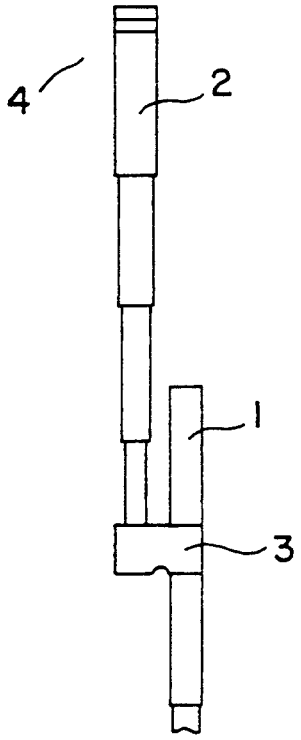
FIG. 1 is a side view of the basic improvement in the aerial work apparatus as contemplated by the present invention showing an auxiliary vertical mast connected to the main vertical mast.

Referring to the drawings, FIG. 1 depicts a telescoping main vertical mast 1 and a telescoping auxiliary vertical mast 2 attached to the main vertical mast 1 by connecting means 3. The main telescoping vertical mast 1 may be rigidly attached at the bottom thereof to an anchoring mechanism (not shown) in the ground, on a floor, on a truck bed, or on a stationary or rotating base on a wheeled chassis. The upper section of the telescoping auxiliary mast 2 may be attached directly to a work platform (not shown) or may be connected to a work platform via a rigid or telescoping boom (not shown). The telescoping vertical main mast 1 and the telescoping vertical auxiliary mast 2 each comprises at least two telescoping sections. The lowest section of each mast has a cross-section which is smaller than that of the next higher section. Each lower section can telescope into the next adjacent higher section. The connecting means 3 is attached to the upper section of the telescoping vertical main mast 1 and the lowermost section of the telescoping vertical auxiliary mast 2.

Figure 2:
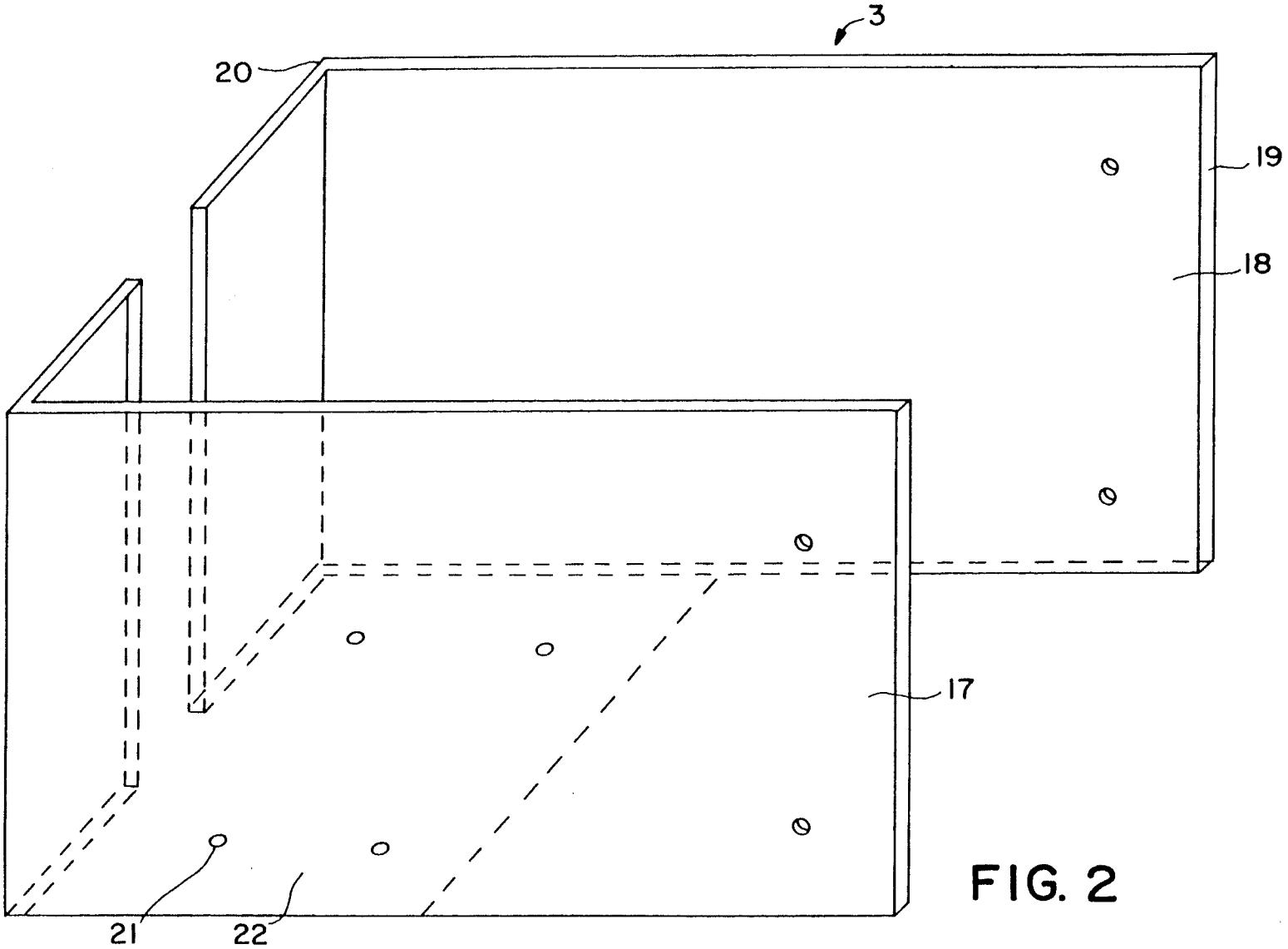
FIG. 2 is a perspective view of a connecting means by which the auxiliary vertical mast may be joined to the main vertical mast.

Referring to FIG. 2, the connection means 3 for connecting an auxiliary vertical mast 2 to the main mast 1 or for connecting two auxiliary masts 2 is shown. The connecting means 3 contains at least two walls, there being two side walls 17 and 18, each side wall 17 18 having a proximal end 19 and a distal end 20. Each side wall 17 18 is preferably "L-shaped" to form a partial enclosure at the distal end 20. Alternatively, a solid endplate (not shown) may connect the two side walls 17 18 at the distal end 20. A bottom 22 extends from a point approximately halfway between the proximal end 19 and the distal end 20 to the distal end 20. The parts of the connecting means 3 may be attached by welds or bolts. Likewise, the proximal end 19 of the connecting means 3 may be attached to the main mast 1 (or supporting auxiliary mast 2) by bolts or welds. For easy attachment and removal, the auxiliary mast 2 is preferably attached to the bottom 22 of the connecting means 3 by bolts through bolt holes 21.

Figure 3:
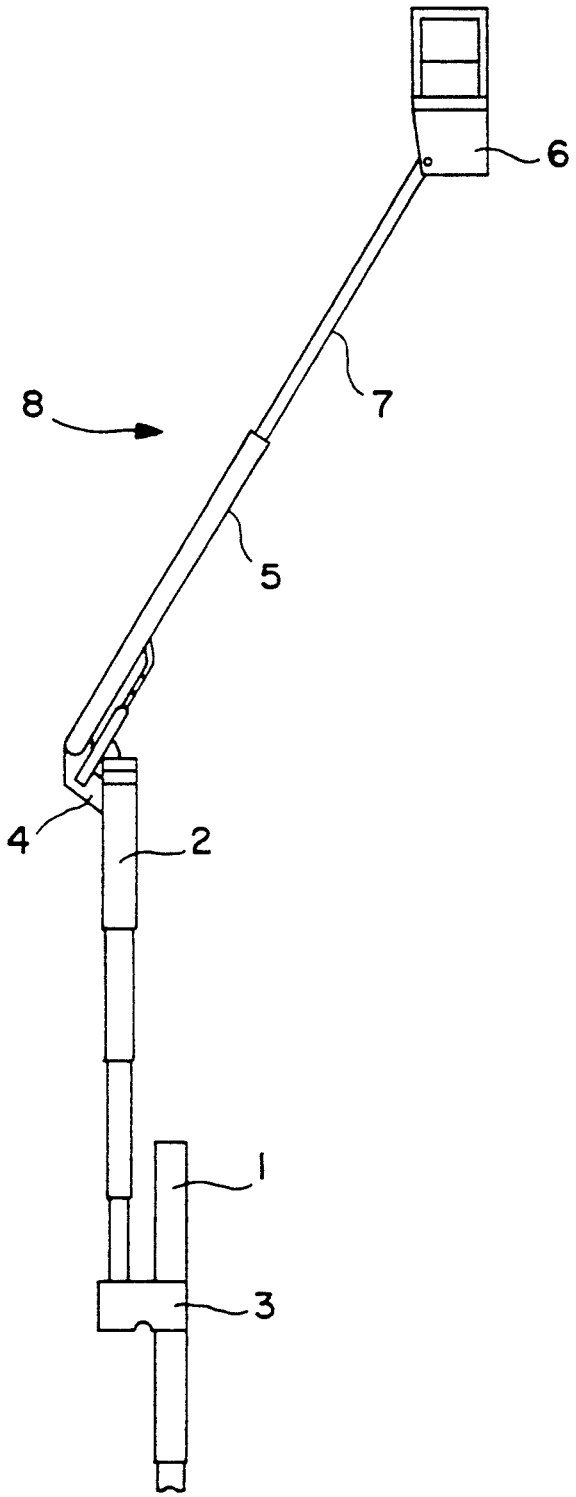
FIG. 3 is a side view of the aerial work apparatus showing a moveable boom attached to an aerial work platform, which boom is attached to the auxiliary vertical mast which is in place on the main vertical mast.

FIG. 3 shows the telescoping vertical auxiliary mast 2 connected to the telescoping vertical main mast 1 via the connecting means 3 and further shows an aerial work platform 6 attached to the upper section of the auxiliary mast 2 via a boom 8 mounted on the auxiliary mast 2 via a boom support 4. The boom support 4 is permanently mounted to the uppermost section of the auxiliary mast 2 by means of welds or bolts. The aerial work platform 6 may be directly mounted to the uppermost section of the auxiliary mast 2 or may, as depicted in the Figure, be attached by a boom 8. The boom 8 may be rigid or, as depicted by the Figure, telescopic, having a proximal section 5 and a distal section 7. The proximal section 5 has a greater cross-section than the distal section 7 and the two sections form a telescopic relationship. The boom 8 may be rigidly attached to the auxiliary mast 2 or it may be movably attached so as to swing in a vertical arc. This attachment is described in detail in FIG. 4.

Figure 4:
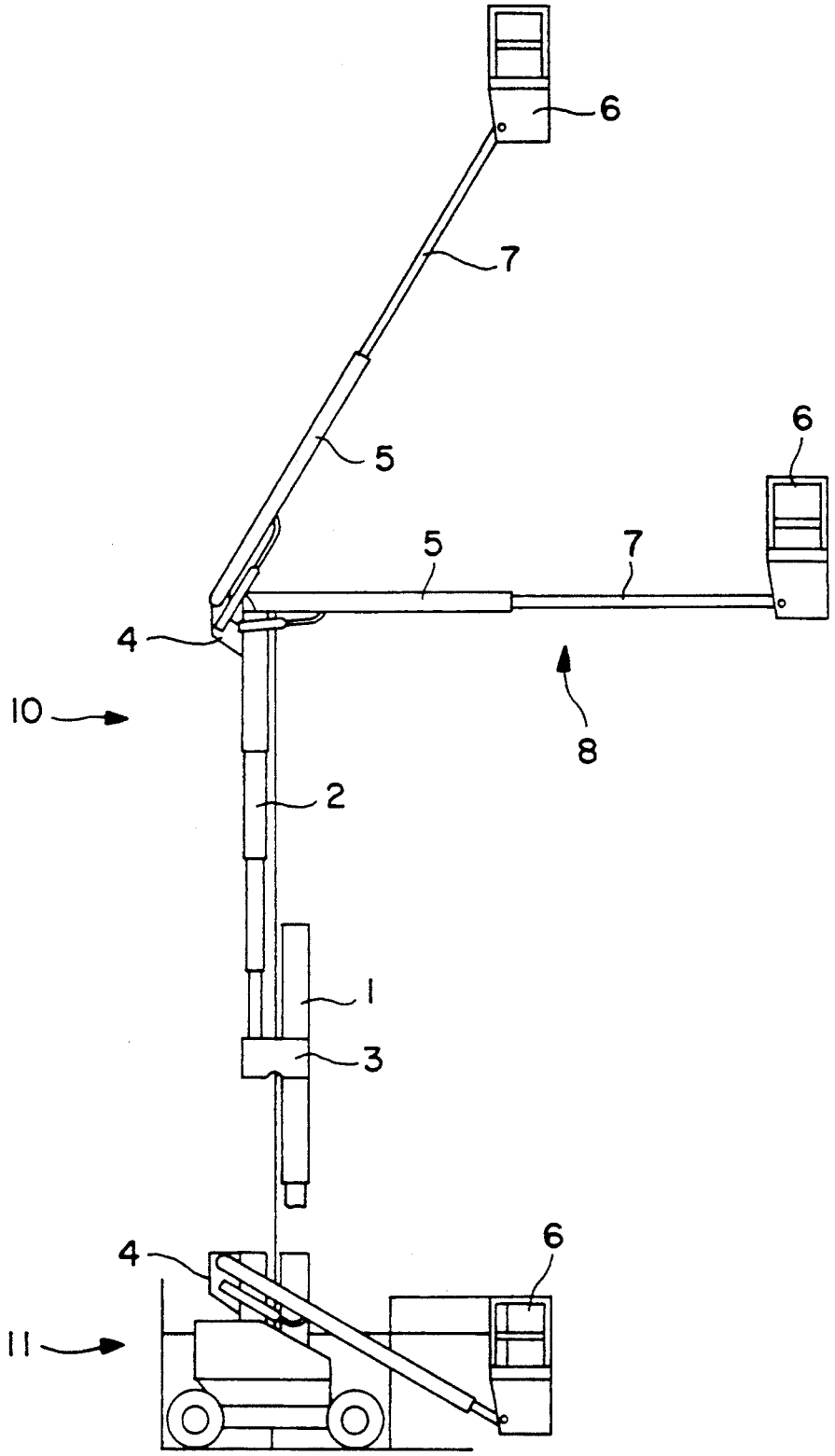
FIG. 4 is a side view of the aerial work apparatus showing the auxiliary vertical mast mounted on the main vertical mast. A boom, mounted on the auxiliary vertical mast, is shown in the relaxed, partially extended and fully extended positions. The main vertical mast is attached to the wheeled chassis described in U.S. Pat. No. 4,511,015.

FIG. 4 depicts a mobile aerial platform apparatus 10 comprising a wheeled chassis 11, a rotating base plate (not shown), a telescoping main vertical mast assembly 1 rigidly attached to the base plate, a telescoping auxiliary vertical mast assembly 2 removably attached to the main mast assembly 1 by a connecting means 3, boom support 4 extending rearwardly from the auxiliary mast 2, a proximal boom section 5 attached to the boom support 4 so as to straddle the auxiliary mast 2 without contacting it on either side, a distal boom 7, telescopically attached to the proximal boom 5, an aerial platform 6 pivotally attached to the distal boom 7, and a control box (not shown) for operating the controls (not shown).

The base plate is rotated by cylinders and a sprocket, chains and a sprocket or cables and rollers (not shown), which are located on the underside of the vehicle, and are known in the art. In the preferred embodiment, wear resistant, low-friction wear pads are inserted under the base plate. The main mast assembly 1 is attached to the base plate by anchoring means such as welds or bolts. In this manner, the downward force of the main mast 1, and auxiliary mast(s) 2, tend to maintain the stability of the aerial platform apparatus 10. The vertical main mast 1 comprises at least two telescoping sections. A lower section of the main mast has a smaller cross-section than the next adjacent higher section.

The mechanism for controlling the movement of the rotating base, the telescoping sections of the main mast and auxiliary mast(s), the telescoping sections of the boom, and the vertical angle of the boom are well known in the art. Hydraulic cylinders integrally attached to each other and its connection to, and location in, the aerial platform apparatus is fully described in U.S. Pat. No. 4,511,015.

Alternatively, the combination of chains and sprockets, cables and rollers, or other well-known control means may be used.

The operator of the aerial platform apparatus 10 can use the control means to propel and steer the aerial platform apparatus 10. Preferably, both front and rear axles are steerable, thereby providing a shorter turning radius. The control means is also used to rotate the base plate, reciprocate the telescopic sections of the main vertical mast 1 and auxiliary vertical mast 2, change the elevation of the boom 8, reciprocate the proximal 5 and distal 7 sections of the boom 8, and adjust the angle between the aerial platform 6 and the boom 8.

In order to maintain stability of the aerial work apparatus, the auxiliary vertical mast 2 may be mounted on any side of the main vertical mast 1. The important feature in maintaining stability is the vertical telescoping motion obtained by both the main mast 1 and the auxiliary mast 2. Other similar apparatuses seek to maintain stability by counterbalancing weights. It has been found that, in the present invention, less counterbalancing is necessary and that the aerial work apparatus maintains stability because the weight of the higher parts is transmitted vertically downward through the telescoping sections of the main mast and the auxiliary mast(s).

Referring again to FIG. 3, the uppermost mast section of the auxiliary support 2 has a boom support 4 permanently attached thereto, preferably by welds or bolts. Boom support 4 is connected to the auxiliary mast 2 near its top and extends from the auxiliary mast 2 in such a manner as to afford easy mounting of the boom 8 and the control means for moving the boom 8 in a vertical arc. It is not necessary that the boom support 4 be mounted on a side of the auxiliary mast 2 opposite from the position of the aerial work platform 6.

The boom assembly 8 comprises a proximal boom section 5 and a distal boom section 7. The distal boom section 7 is smaller in cross-section than the proximal boom section 5 to allow for reciprocation between the two sections and the resulting shortening or lengthening of the boom 8. The proximal end of the boom 8 is attached to the boom support 4 in a manner as to allow for arcuate movement of the boom 8. An example of such an attachment is fully described in U.S. Pat. No. 4,511,015. In this patent, the proximal boom section 5 straddles the auxiliary mast 2. One leg of the proximal boom 5 extends from the boom support 4 along one side of the auxiliary mast 2 without contacting the auxiliary mast 2, while the other leg of the proximal boom 5 extends in a like manner on the opposite side of the auxiliary mast 2.

Aerial platform assembly 6 is pivotally connected to the distal boom section 7. The manner of this assembly is described in detail in U.S. Pat. No. 4,511,015.

The foregoing description is of a mast construction for an aerial work platform apparatus and the assembled aerial work platform having extended height and improved stability. The extended height is accomplished by the attachment of at least one auxiliary vertical telescoping mast. The relative stability is a result of how the height is achieved, more through direct vertical motion and less through boom reach and articulation than other designs.

The preferred embodiments described above are used as illustrations and are not intended as a limitation on the scope of the invention.

We claim:

1. A mast assembly for an aerial work platform, comprising a telescoping vertical main mast containing at least lower and upper sections so that there is an uppermost section and each section except the uppermost section has a next adjacent higher section, at lest one telescoping vertical auxiliary mast so that there is an uppermost auxiliary mast, each auxiliary mast containing at least lower and upper sections so that there is an uppermost section and each section except the uppermost section has a next adjacent higher section, the lower sections being of a smaller cross-section than the next adjacent higher sections and being capable of telescoping into the higher sections, the main mast and the auxiliary mast being attached via a connecting means having a bottom and at least tow side walls, which connecting means is attached to the upper section of the main mast and the lower section of the auxiliary mast fits into, and is secured by, the connecting means.

2. The mast assembly of claim 1, wherein the lower section of the main mast is anchored to a support means.

3. The mast assembly of claim 2, wherein the upper section of the uppermost auxiliary mast has a support means mounted thereon.

4. An aerial work apparatus which comprises the mast assembly of claim 3 and a work platform connected to the support means mounted on the auxiliary mast.

5. The aerial work apparatus of claim 4, wherein the work platform is connected to the support means by a boom.

6. The aerial work apparatus of claim 5, wherein the boom comprises at least a proximal section and a distal section, the proximal section having a greater cross-section than the distal section, and the proximal and distal sections having a telescoping relationship.

7. The aerial work apparatus of claim 6, wherein the boom is attached to the support means in such a manner as to allow the boom to move in a vertical arc.

8. In an aerial platform apparatus comprising:

a) a wheeled chassis, b) an aerial platform, c) a base plate mounted on the wheeled chassis, d) a fully hydraulic, telescoping, main vertical mast mounted on the base plate, which main vertical mast includes at least two telescoping sections so that there is at least a lower section and an upper section, and each section except the upper section has a next adjacent higher section, the lower section being smaller in cross-section than the next adjacent higher section, and e) a telescoping boom having a proximal end and a distal end, the improvement which comprises: an auxiliary vertical telescoping mast mounted to the upper section of the telescoping main vertical mast, the auxiliary vertical mast containing at least two telescoping sections so that there is at least a lower section and an uppermost section and each section except the uppermost section has a next adjacent higher section, the lower section being of smaller cross-section than the next adjacent higher section, the proximal end of the telescoping boom being attached to the uppermost section of the auxiliary mast via a support means and the distal end of the boom being attached to the aerial work platform, the lower section of the auxiliary vertical telescoping mast being mounted to the upper section of the telescoping main vertical mast by a connecting means having a bottom and at least two side walls, which connecting means is connected to the upper section of the main vertical mast and the lower section of the auxiliary mast fits into, and it secured by, the connecting means.

* * * * *

UNITED STATES PATENT AND TRADEMARK OFFICE

CERTIFICATE OF CORRECTION

PATENT NO. 5,307,898
DATED May 3, 1994
INVENTOR(S) PURDY et al.

It is certified that error appears in the above-indentified patent and that said Letters Patent is hereby corrected as shown below:

Claim 1, column 5, line 16, "tow" should read --two--.

Signed and Sealed this

Sixteenth Day of August, 1994

*Attest:*

*Attesting Officer*

BRUCE LEHMAN

*Commissioner of Patents and Trademarks*